United States Patent [19]

Saccoccio

[11] 3,990,266

[45] Nov. 9, 1976

[54] EAR CLIP HAVING A SOFT, DURABLE SPRING ACTION

[75] Inventor: Nazareno J. Saccoccio, Cranston, R.I.

[73] Assignee: Aro-Sac Inc., Providence, R.I.

[22] Filed: Oct. 28, 1975

[21] Appl. No.: 626,579

[52] U.S. Cl. ..... 63/14 D; 24/252 B; 24/248 JE

[51] Int. Cl.[2] ..... A44C 7/00

[58] Field of Search ..... 63/14 R, 14 B, 14 C, 63/14 D, 14 E; 24/248 JE, 252 J, 252 B

[56] References Cited

UNITED STATES PATENTS

| | | | |
|---|---|---|---|
| 1,967,965 | 7/1934 | Morehouse et al. | 24/252 B |
| 3,484,909 | 12/1969 | Sauer | 63/14 D X |
| 3,509,733 | 5/1970 | Crowley | 63/14 R |

*Primary Examiner*—F. Barry Shay
*Attorney, Agent, or Firm*—Salter & Michaelson

[57] ABSTRACT

The present invention is directed to an ear clip for earrings and the like in which separate jaw portions thereof are attached together for pivotal movement towards and away from each other in such a manner that the need for a separate spring member is eliminated and a soft and durable spring action between opposed ear lobe contacting pads is produced. The construction includes a stationary body portion having a lobe contacting pad at one end and a movable clip arm pivotally attached to the other end, said clip arm having integral spring means associated therewith. The spring means is formed by a series of reverse folds producing spring action at a plurality of separate points within the clip and in this manner accomplishes the aforementioned desirable soft touch between the opposed pad sections which contact opposite sides of the ear lobe and serve to suspend the clip therefrom. The clip arm lobe contacting pad may be and is preferably formed integrally with the spring means.

7 Claims, 6 Drawing Figures

EAR CLIP HAVING A SOFT, DURABLE SPRING ACTION

BACKGROUND OF THE INVENTION

Conventional ear clips normally take the form of separate pivotally attached stationary and movable jaw portions. The stationary jaw or body portion normally includes a separate leaf spring attached thereto by means of upwardly bent tabs and the like and which serves to engage terminal portions of the movable jaw or clip arm near its attachment to the body so as to resiliently urge the clip arm to a fully open and/or to a fully closed position. The metal stock material, such as phosphor-bronze, required for the formation of such separate leaf springs, is expensive and, furthermore, necessitates a separate and accordingly costly added assembly operation.

Accordingly, considerable effort has been made to produce ear clips which eliminate a separate spring member. U.S. Pat. No. 2,945,363 issued July 19, 1960, and U.S. Pat. No. 3,159,894 issued Dec. 8, 1964, are representative of the type constructions which such effort has produced. Such constructions incorporate a spring integrally struck from the movable jaw or clip arm. Although operative, such constructions necessarily enable very little control over the spring force produced thereby and necessarily exhibit sharp outwardly projecting portions in their closed position which could scratch or snag the clothing of the wearer. Accordingly, it would be desirable to produce an ear clip having an integral spring member which avoids these prior-art drawbacks and which additionally produces a resultant spring action wherein the opposed lobe contacting pads come together with the proper degree of resiliency so as to enhance the wearing comfort of earrings incorporating such clip structure.

SUMMARY OF THE INVENTION

The present invention accomplishes these aims while avoiding the above and other prior art drawbacks by the provision of a clip for earrings and the like having a body or stationary jaw member having a clip arm pivotally attached thereto, said clip arm having integral spring means normally urging the clip arm either to a fully closed position or a fully open position. Such integral spring means includes a plurality of reverse folds so as to produce separate and distinct spring action at a plurality of different points in the overall structure of the clip.

It is accordingly the primary object of the present invention to produce an ear clip incorporating integral spring means so as to reduce the expensive of known clip structures incorporating separate leaf springs.

Another object of the present invention is the production of a low-cost ear clip which involves a minimum of assembly and which in large part may be formed by automatic machinery.

A further object of the present invention is to produce an ear clip comprising an integral spring construction wherein the movable clip arm portion thereof includes a plurality of separate localized areas of spring tension at different locations within the overall spring means, which enables a firm yet resilient "soft touch" action to exist between the opposed ear lobe pads of the stationary and movable parts when the clip is in its closed or gripping position.

Other objects, features and advantages of the invention will become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
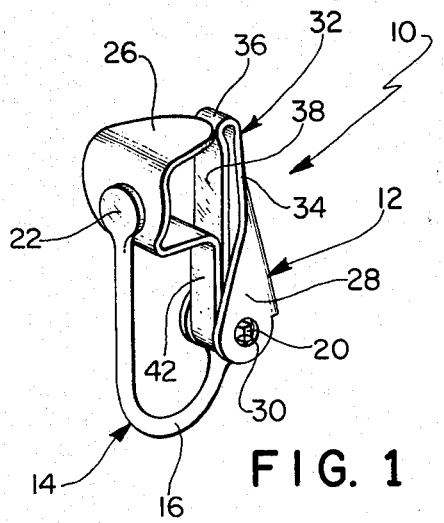
FIG. 1 is a perspective view of an earring clip embodying the present invention.
Figure 2:
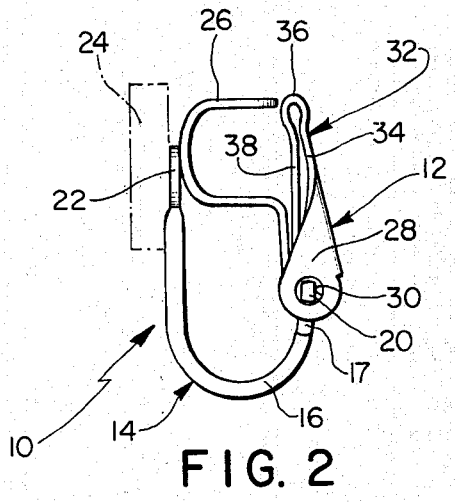
FIG. 2 is a side elevational view thereof.
Figure 3:
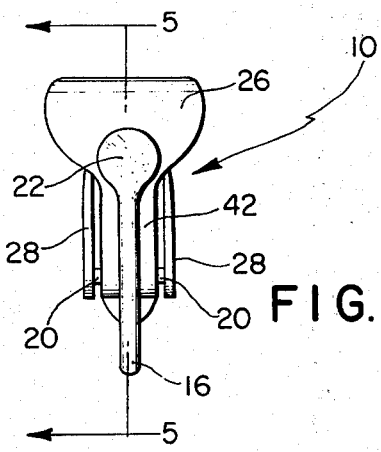
FIG. 3 is an end view of the clip taken from the left of FIG. 2.
Figure 4:
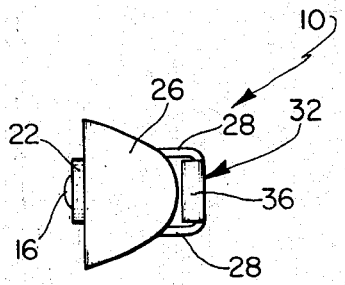
FIG. 4 is a top plan view.

Referring now to the drawings, an earring 10 is shown as comprising a movable jaw member or clip arm 12 and a stationary jaw member or body 14 connected together at lower portions thereof for pivotal movement with respect to each other. The body 14 is of an overall J-shaped configuration and has a lower curved loop portion 16 and a slightly outwardly flared extension 17 which extends upwardly and terminates in an outer edge 18. The extension 17 includes outwardly extending pintles 20. The other end of the clip arm 14 terminates in a generally circular pad or first ear lobe contact member 22 which is adapted to receive a decorative element 24 as best shown by the dotted-line representation in FIG. 2 of the drawing. As is known, pad 22 is adapted to press inwardly upon outer portions of the wearer's ear lobe, and the lower loop portion 16 thereof is adapted to extend around the lower portions of the lobe.

The movable jaw or clip arm 12 includes a second ear lobe contact pad 26 at one end thereof and a pair of generally parallel spaced ears 28 each having an opening 30 therethrough for receipt of the body pintles 20 at the other end thereof. Such ears and openings form the receiving or connection means by which clip arm 12 is pivotally attached to the body 14 and operable to closed and open positions thereof, as will hereinafter be more fully brought out. Interconnecting the second ear lobe contact 26 with the clip arm receiving means of the body is an integral spring means 32, including a first run 34 extending between the connection means and a first reverse fold 36, a second intermediate run 38 connecting the first fold 36 to a second fold 40, and a third run 42 connecting the second reverse fold 40 to the pad portion 26 of the member 12, which pad portion may be and preferably is an integral extension of the run 42. Alternately, however, the third intermediate run 42 may terminate in a straight run to which a separately formed lobe contact pad 26 is attached thereto by known means, such as brazing, adhesive connection or the like.

Figure 5:
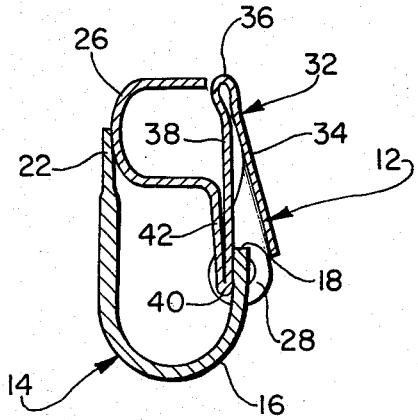
FIG. 5 is a side sectional view similar to FIG. 2 taken along the line 5—5 of FIG. 3.
Figure 6:
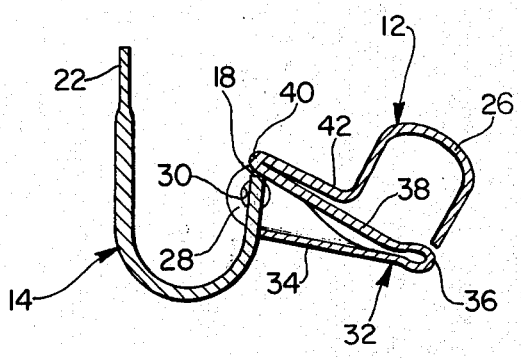
FIG. 6 is a side sectional view similar to FIG. 5 but depicting the clip arm moved to its open position.

As best shown in FIG. 5 of the drawing, the second intermediate run 38, proximate its connection with the second reverse fold 40, is adapted to contact portions of the flared extension 17 of loop 16 so as to spring urge the clip arm 12 to its closed clip position wherein the first lobe contacting pad 22 engages or approaches actual engagement with the second ear lobe contacting pad 26, whereby to resiliently grip an ear lobe positioned therebetween. Additional spring action is brought about at several independent points along the integral spring means 32 and, more specifically, a first and main spring action take place at the first reverse fold 36, enabling outward flexing between the first and second runs which necessarily takes place in the transition between closed and open positions, as best shown by a comparision of FIGS. 5 and 6 of the drawing, noting that in FIG. 6 the first and second runs are more outwardly spread proximate the clip arm connecting means and that underportions of the second run 38 proximate the second reverse fold 40 contact outer edge 18. Such action enables the clip arm 14 to remain in the open position depicted in FIG. 6. A second spring action location exists at and is accomplished by the second reverse fold 40 wherein, as best depicted in FIGS. 5 and 6 of the drawing, the slight spacing between the second and third runs enables a slight inward resilient movement of the pad 26 towards the spring means and about the second reverse fold 40 until the third run 42 makes abutting engagement with said second intermediate run 38. A third localized spring action is accomplished by the interaction between the flared extension 17 and its terminal edge portion 18 and underportions of the second intermediate run proximate the second reverse fold 40 as when the clip arm 12 is moved to the open position illustrated in FIG. 6.

It is thus apparent that the integral spring means 32 of the present invention enables three different spring actions to take place during different operational modes of the present clip construction. Thus, when the clip arm of the present construction is moved between open and closed positions, spring action is mainly provided at the first and third locations above described. When the clip arm is in its closed position, the first and second spring actions provided by the first reverse fold 36 and the second reverse fold 40 result in a soft touch between the opposed lobe contact pads 22 and 26, that is, this combined spring action enables some possible inward independent deflection of pad 26, even after the clip arm has been moved to its closed position. This construction results in an extremely soft yet secure gripping action of the clip to the ear lobe and at the same time assures comfortable wearing characteristics for earrings incorporating the present novel clip.

The elements forming the present clip construction may be formed of conventional jewelry alloy material, such as copper alloy, shaped, cut and formed by suitable die forming operations. The movable clip arm may be and preferably is heat tempered to assure maintenance of the desired separate spring action throughout different portions thereof over the required number of flexures to which the clip structure will be subjected during normal usage.

While there is shown and described herein certain specific structure embodying the invention, it will be manifest to those skilled in the art that various modifications of the parts may be made without deparing from the spirit and scope of the underlying inventive concept and that the same is not limited to the particular forms herein shown and described except insofar as indicated by the scope of the appended claims.

What is claimed is:

1. A clip for earrings and the like having a body and a clip arm, said body having a first ear lobe contacting pad at one end thereof and connection means at the other end thereof, one end of said clip arm having means for receiving said body connection means so as to pivotally attach said clip arm to said body for relative spring urged movement towards and away from said body in respective closed and open positions of said clip, the other end of said clip arm having integral spring means including a first reverse fold forming a first spring and first and second runs extending respectively from said clip arm one end to said first fold and from said first fold to a terminus, said second run engaging said other end of said body to resiliently maintain the clip in said closed and open positions, said terminus of said clip arm including a second ear lobe contacting pad, whereby said pads are urged together by said spring means so as to enable suspension of said clip from said lobe, said spring means including first and second reverse folds, said second run extending from said first fold to said second fold, and a third run extending from said second fold to said terminus, said second ear lobe contacting pad integrally formed from a continuation of said third run.

2. The clip structure of claim 1, said first and second runs openly divergent in opposed spaced relationship to each other, said second run engaging said other end of said body proximate said second reverse fold.

3. The clip structure of claim 1, said body connection means including a terminal portion having outwardly extending pintles, said clip arm receiving means including spaced generally parallel ears having openings therethrough for receipt of said pintles, said second run contacting said body terminal portion to respectively urge said clip arm to maintain open and closed positions relative to said body.

4. A clip for earrings and the like consisting of a body and a clip arm pivotally connected together at an end thereof for relative movement towards and away from each other, said body having an ear lobe contacting pad at its free end, said clip arm having an ear lobe contacting pad at its free end and integral spring means connecting the ends of said clip arm, said spring means including first and second reverse folds, an intermediate run extending between said folds and runs extending outwardly from said folds to join said first fold to said end connected to said body and said second fold to said clip arm ear lobe contacting pad.

5. The clip structure of claim 4, said clip arm ear lobe contacting pad formed from an integral continuation of said run outwardly extending from said second reverse fold.

6. The clip structure of claim 4, said body including a terminal portion having outwardly extending pintles, said clip arm including at its connection end spaced generally parallel ears having openings therethrough for receipt of said pintles, said run connecting said reverse folds contacting said body terminal portion to respectively urge said clip arm into open and closed positions relative said body.

7. The clip structure of claim 5, said clip arm pad being of generally U-shaped configuration and disposed with the closed end thereof in opposed facing relation to said body pad, one of the legs of the U-shape extending substantially perpendicular from said adjacent outwardly extending run, and the other leg having its free end terminating adjacent to but slightly spaced from said first fold.

* * * * *